United States Patent [19]

Van Dijk

[11] Patent Number: 4,711,004

[45] Date of Patent: Dec. 8, 1987

[54] APPARATUS FOR SHEARING A MOVING WEB OF MATERIAL

[75] Inventor: Alfonsius A. J. Van Dijk, St. Odilienberg, Netherlands

[73] Assignee: Johannes Menschner Maschinenfabrik GmbH & Co. KG, Viersen, Fed. Rep. of Germany

[21] Appl. No.: 925,887

[22] Filed: Oct. 30, 1986

[30] Foreign Application Priority Data

Nov. 2, 1985 [DE] Fed. Rep. of Germany ..... 3538922

[51] Int. Cl.[4] ..... D06C 13/00; D06C 23/02

[52] U.S. Cl. ..... 26/15 R; 26/16

[58] Field of Search ..... 26/15 R, 15 L, 15 FB, 26/16

[56] References Cited

U.S. PATENT DOCUMENTS 459,725 9/1891 Spencer ..... 26/16

1,253,049 1/1918 Kitsee ..... 26/16

2,129,236 9/1938 Richardson ..... 26/15 L

FOREIGN PATENT DOCUMENTS 336044 3/1959 Switzerland ..... 26/15 R 2929 of 1890 United Kingdom ..... 26/15 R 28330 of 1911 United Kingdom ..... 26/16

*Primary Examiner*—Robert R. Mackey

*Attorney, Agent, or Firm*—Karl F. Ross; Herbert Dubno

[57] ABSTRACT

The cutting apparatus for cutting a moving strip of material comprises a rotating cutting cylinder having a spatially fixed nap height determining plate provided with a plurality of holes which contacts a part of the active outer circumference of the cutting cylinder. The exterior side of the plate is the bearing surface for the strip of material and the holes provide opposing cutting edges for a plurality of cutting edges of the cutting cylinder.

8 Claims, 4 Drawing Figures

APPARATUS FOR SHEARING A MOVING WEB OF MATERIAL

FIELD OF THE INVENTION

My invention relates to an apparatus for shearing a moving web of material using a rotating shearing cylinder.

BACKGROUND OF THE INVENTION

An apparatus for shearing a moving web of material can have a rotating shearing cylinder. There are of course a number of possible configurations for such a cutter. On the outer circumferential surface of the shearing cylinder, helical shearing blades, the so called "spiral cutters", can be mounted. Normally such shearing tools work together with one or more shearing tools having opposing shearing knives. The number of opposing knives and the number of spiral blades are determined by the shearing output required of the shearing apparatus.

OBJECTS OF THE INVENTION

It is an object of our invention to provide an improved shearing apparatus for shearing a web of material which avoids drawbacks of earlier machines for this purpose.

It is also an object of my invention to provide an improved shearing apparatus for shearing a web of material by a rotating shearing cylinder in which the conventional opposing shearing knives are replaced by a different structure.

It is another object of my invention to provide an improved shearing apparatus for shearing a moving web of material by a rotating shearing cylinder in which the shearing performance is significantly improved.

SUMMARY OF THE INVENTION

These objects and others which will become more readily apparent hereinafter are attained in accordance with my invention in a shearing apparatus for shearing a moving web of material with a rotating shearing cylinder.

According to my invention, a spatially fixed nap-height determining plate provided with a plurality of holes or windows contacts a part of the circumference of the shearing cylinder. The exterior side of the plate is the bearing surface for the web of material and the edges of the holes provide opposing shearing surfaces or counteredges for the shearing edges of the shearing cylinder.

Every hole of the plate positioned in the path of motion of a shearing blade of the shearing cylinder forms a stationary opposing shearing element, the hole edge, facing the rotating shearing blade.

Each surface region of the web of material can be engaged and cut at a plurality of shearing positions. The effectiveness of the multiple shearing elements used in my invention only depends on the structure of the holes and on the inclination angle or pitch of the shearing blades of the shearing cylinder. Here many possible variations result.

The invention moreover has a great many more advantages. Thus a special adjustment of the shearing or nap height is no longer required and the thickness of the plate is nap-height determining.

The web of material with its surface to be worked on rides on the outer surface of the plate facing away from the shearing cylinder and the plate for its part contacts with its interior side on the shearing elements of the shearing cylinder which slide along on this interior side.

As a result of this contact of the web of material on the plate, the web of material is supported over its entire shearing zone and its entire width and bearing surface exert a bending effect on the web of material.

This is a great advantage since a web of material with loose or wave like edges no longer requires an edge clamp. Such edge clamps were necessary up to now and, while leading to smoothing of the edges permitted zones of slackness to arise elsewhere, which had to be eliminated by a width maintaining device. This kind of tensioning of the web of material can now be eliminated along with the trouble and cost it entailed.

With my invention a low tension shearing is possible, any existing folds being smoothed out by the contact of the web of material on the exterior plate side. A smoothing of the web of material can be ensured by applying a suction to the shearing zone.

Conventional shearing machines must be adjustable for different web thicknesses to guarantee a constant nap height. In the shearing apparatus according to my invention, the constant nap height is guaranteed by the thickness of the plate.

Different thicknesses are not found in the sheared product, because the web of material is not guided with its underside over a cutter table but rather along its nap side over the plate.

The use of the cutter table can thus be eliminated.

Usually textile fabrics before the shearing are sewn together into a long web of material. Conventional shears require a seam detector and processor to prevent the sealed seam from entering into the shearing tool and thus damaging the web of material and/or the cutter tool. To detect the seam, complex and expensive devices are necessary. For seam processing, either the position of the shearing tool is held and the shearing table moved away or the shearing cylinder is caused to pivot away from the opposing knife.

It is known also to slide a seam protective cover element between the web of material and the cutter when the seam passes. All these methods are very expensive and lead to interruption of the production cycle and/or to interference with it when even only short strips of material are used.

According to my invention, neither a seam detector nor a seam processor is required. Since the seam zone is also guided over the outside of the plate, the cutter need not be disturbed by the seam or damaged by its passing.

Increased advantages result since the web of material which engages a part of the circumference of the cutter is guided along on the cutter with the surface to be worked on without the web of material being supported on its back side by the conventional shearing table. Consequently irregularities, faults or the like in the back side of the web of material, e.g. binding faults, do not effect the shearing product. A kind of bent bearing surface for the web of material is found on the outer side of the apertured plate which guarantees the constancy of the shearing height.

All these important disadvantages are surprisingly attained with a simultaneously increased simplification of the device.

The apparatus according to my invention is particularly suited for velour or carpet nap shearing or for the trimming of fabric, e.g. to remove production ends or knots.

Advantageously, the plate can be a flexible foil, particularly a comparatively thin metal plate. A foil or plate with a thickness of 0.10 to 1.5 mm is preferably used.

The plate can be held fixed in the web running direction behind the shearing cylinder (upstream of it) and is held against the shearing cylinder based on the tension in the web of material.

It is possible also to use an adjustable tension providing device to hold the plate tight.

When one uses a plate with a plate zone without holes bounding the plate in the axial direction of the shearing cylinder, one can make a shearing pattern in a simple way. Thus it is possible to impart a striped pattern to the web of material when one guides it over different holed plates and only cuts one or more longitudinal zones.

BRIEF DESCRIPTION OF THE DRAWING

The above and other objects, features and advantages of the present invention will become more readily apparent from the following description, reference being made to the accompanying highly diagrammatic drawing in which.

SPECIFIC DESCRIPTION

Figures 1, 3:
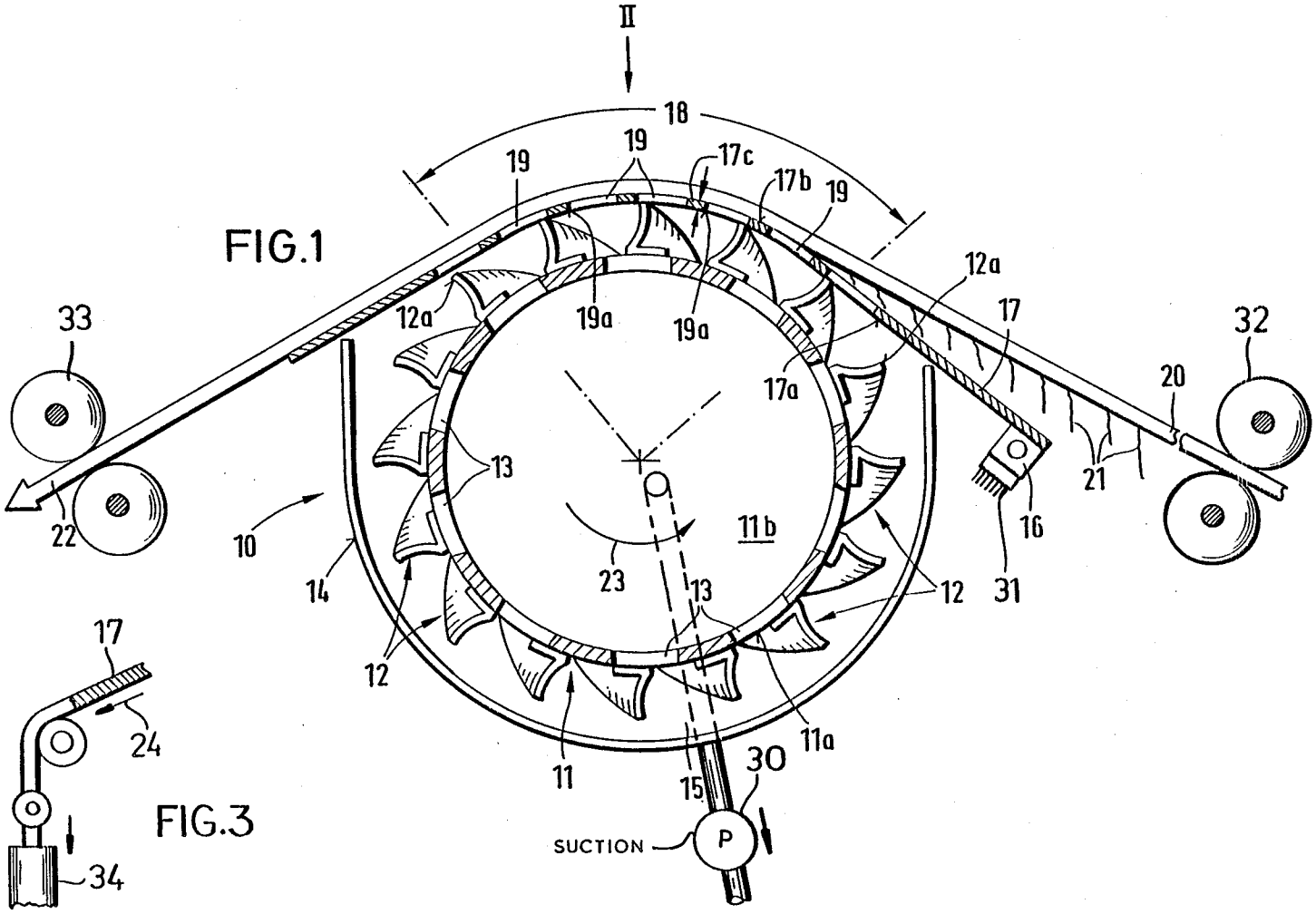
FIG. 1 is a cross sectional view through an apparatus for shearing a moving web according to my invention showing the shearing zone.
FIG. 3 is a cross sectional view through an alternative embodiment of a shearing apparatus according to my invention showing the shearing zone.

The shearing apparatus comprises a shearing cylinder 11 on whose circumferential jacket surface 11*a* a plurality of spiral shearing blades 12 are mounted in a known way.

The shearing cylinder 11 is a hollow cylinder; its jacket is provided with a plurality of air outlets 13.

The interior space 11*b* of this hollow cylinder 11 can be connected to a source of vacuum 30 by which the shearing zone can be evacuated on the one hand to hold the nap or pile erect and on the other hand to remove cut away particles, contaminants, loose fibers or the like. In order to limit the desired suction in the shearing zone, the outside of the shearing cylinder 11 is enclosed outside of the shearing zone by a covering hood 14.

Figure 2:
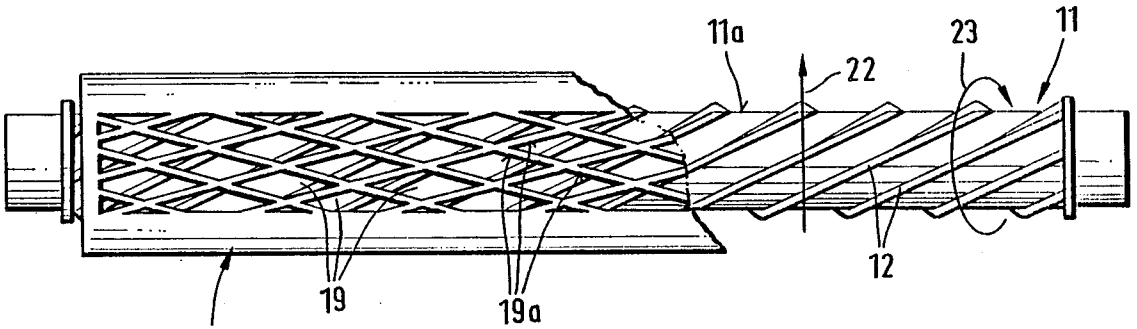
FIG. 2 is a schematic elevation view in the direction of the arrow II of FIG. 1.

Instead of this "interior suction" it is possible to connect the vacuum source 30 to the interior space 15 which is between the shearing cylinder 11 and the hood 14. In this case, the shearing cylinder 11 can be enclosed as seen in FIG. 2.

A plate 17 is attached in one piece with a bracket 16 fixed to the machine frame 31. This plate 17 contacts a part of the circumference 18 of the shearing cylinder 11 and is provided with a pattern of holes; individual holes are indicated at 19.

Interiorly in the part of the circumference 18 where the shearing cylinder 11 contacts the plate 17, the cutter and/or shearing edges or elements 12*a* of the spiral shearing blades 12 slide along on the inner or bottom side 17*a* of the plate 17.

The outer side 17*b* of the plate 17 acts as a bearing or supporting surface for a web of material 20 which is guided over the plate 17 which is turned with its side to be worked on having the nap or pile 21 toward the shearing cylinder 11.

The plate 17 and the web of material 20 are pressed to the part of the circumference of the shearing cylinder 11. The web running direction is indicated with the arrow 22, the rotation direction of the shearing cylinder 11 with the arrow 23.

To press the shearing cylinder periphery satisfactorily, the plate 17 can be formed as a flexible foil.

Since the web of material 20 is fed with a fixed tension, e.g. via the rolls 32, 33, it is sufficient to hold the plate 17 in its designed position. For the case in which this is not desired or sufficient, an adjustable tension providing device for tensional holding of the plate 17 is provided indicated with the arrow 24.

It is essential that the plate 17 and/or the foil be easily exchangeable in order to be able to manage the wear on these parts.

Those edges 19*a* of the holes 19 which are directed in the direction of rotation 23 of the shearing cylinder 11 form opposing shearing edges for the shearing elements or edges 12*a* of the spiral cutter blades 12. In the course of its motion through the shearing zone, each spiral blade 12 meets a plurality of such opposing shearing edges 19*a*. As a result, an exact shearing operation is attained. In so far as the opposing shearing edges 19*a* do not have an exact alignment with the pitch of the helical spiral blade 12, consequently— as shown in FIG. 2— there is an opposing angular deviation so that a good cut occurs continuously. The thickness 17*a* of the plate 17 is determined for the nap or shearing height.

Figure 4:
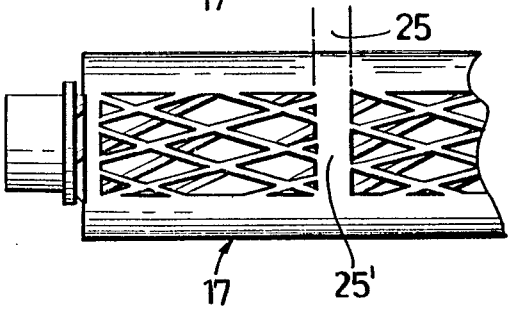
FIG. 4 is an illustration of a modification of FIG. 2.

In FIG. 2, the plate 17 is shown to have a diamond shaped array of holes. One sees as is indicated in FIG. 4 with 25, a plate segment which is without holes bounding the plate in the the axial direction of the shearing cylinder; no shearing occurs in this holeless zone. With these segmented plates, zone effects are obtained in the web of material, particularly including other shearing heights— particularly by subsequently shearing of these unprocessed sections occurring as a result of the holeless zones of the plate.

A fluid operated cylinder 34 applies tension 24 to the foil, if desired, as shown in FIG. 3.

I claim:

1. A shearing apparatus for shearing a web of moving material comprising:

a rotating shearing cylinder having a plurality of spiral shearing blades mounted on the outer circumferential surface of said shearing cylinder, each of said spiral shearing blades having a shearing edge and the axis of said shearing edge of said spiral shearing blade being at least substantially parallel to the axial direction of said shearing cylinder; and a spatially fixed nap height determining plate provided with a plurality of holes, the edges of which contact said shearing edges of said spiral shearing blades along a part of the circumference of said shearing cylinder, the exterior side of said plate being the bearing surface for said web of material and the edges of said holes providing a plurality of opposing shearing edges for a plurality of said shearing edges of said shearing cylinder.

2. An apparatus according to claim 1 wherein said plate is flexible and foil like.

3. An apparatus according to claim 1 wherein said plate is fixed in position upstream with respect to the motion of said web of material and is held against said shearing cylinder by the tension in said web of material alone.

4. An apparatus according to claim 1 wherein said plate is held against said shearing cylinder by an adjustable tension providing device for holding tight said plate.

5. An apparatus according to claim 1 wherein said plate has a plate zone not provided with said holes bounding said plate in the axial direction of said shearing cylinder.

6. An apparatus according to claim 1 further comprising a vacuum means communicating with said plate.

7. An apparatus according to claim 1 wherein said opposing shearing edges of said plate are formed as a stripped pattern.

8. An apparatus according to claim 1 wherein said opposing shearing edges of said plate are a diamond shaped array.

* * * * *